US010864397B2

(12) United States Patent
Beasley

(10) Patent No.: US 10,864,397 B2
(45) Date of Patent: Dec. 15, 2020

(54) FIRE PROTECTION SYSTEM MANIFOLD

(71) Applicant: Ronald Beasley, Lafayette, GA (US)

(72) Inventor: Ronald Beasley, Lafayette, GA (US)

( * ) Notice: Subject to any disclaimer, the term of this patent is extended or adjusted under 35 U.S.C. 154(b) by 286 days.

(21) Appl. No.: 16/048,955

(22) Filed: Jul. 30, 2018

(65) Prior Publication Data

US 2019/0030384 A1 Jan. 31, 2019

Related U.S. Application Data

(60) Provisional application No. 62/538,980, filed on Jul. 31, 2017.

(51) Int. Cl.

| | |
|---|---|
| ***A62C 35/68*** | (2006.01) |
| ***F17C 13/00*** | (2006.01) |
| ***A62C 35/02*** | (2006.01) |

(52) U.S. Cl.

CPC ..... *A62C 35/68* (2013.01); *A62C 35/02* (2013.01); *F17C 13/00* (2013.01); *Y10T 137/794* (2015.04); *Y10T 137/85938* (2015.04); *Y10T 137/87249* (2015.04)

(58) Field of Classification Search

CPC ..... A62C 35/02; A62C 35/00; A62C 35/58; A62C 35/60; A62C 35/62; A62C 35/68; F16L 41/025; F16L 41/03; F16L 41/021; F16L 41/023; Y10T 137/794; Y10T 137/7976; Y10T 137/8085; Y10T 137/8122; Y10T 137/87249; Y10T 137/87877; Y10T 137/85938

See application file for complete search history.

(56) References Cited

U.S. PATENT DOCUMENTS

| | | | | |
|---|---|---|---|---|
| 2,706,006 A * | 4/1955 | Valente | A62C 35/58 169/16 |
| 4,045,351 A * | 8/1977 | Peterson | B01D 35/02 210/238 |
| 4,536,104 A * | 8/1985 | Bungert | B65G 53/528 406/183 |
| 5,117,864 A * | 6/1992 | Byers | B25B 27/24 123/90.1 |
| 5,176,177 A * | 1/1993 | Rupp | A62C 33/00 137/561 A |
| 5,197,548 A * | 3/1993 | Volker | A62C 31/02 169/11 |
| 6,494,325 B1 * | 12/2002 | Mizrahi | B01D 35/02 137/550 |
| 7,216,672 B1 * | 5/2007 | Chen | F16K 11/20 137/883 |
| 7,780,013 B1 * | 8/2010 | Kern | A62C 33/00 137/272 |

(Continued)

*Primary Examiner* — David Colon-Morales

(74) *Attorney, Agent, or Firm* — Chambliss, Bahner & Stophel, P.C.

(57) ABSTRACT

A manifold for supplying multiple water streams, which streams may be used in connection with fire protection systems, from a single water supply source. The system includes an elongate body portion for holding water. Body portion has spaced apart first and second ends and a wall having a non-circular cross section with a top portion and converging side portions join the top portion and a bottom portion. A water inlet extends from the bottom of the body portion. A pair of water outlets extend from the top of the body portion and are located proximate the first and second ends of the body portion.

20 Claims, 7 Drawing Sheets

(56) References Cited

U.S. PATENT DOCUMENTS

| | | | | |
|---|---|---|---|---|
| 7,886,837 | B1 * | 2/2011 | Helfgott | A62C 35/68 169/5 |
| 9,016,392 | B2 * | 4/2015 | Khalil | A62C 35/02 169/14 |
| 2004/0130146 | A1 * | 7/2004 | Mays | F16L 41/021 285/133.11 |
| 2006/0097069 | A1 * | 5/2006 | Sundholm | A62C 35/68 239/127 |
| 2013/0299018 | A1 * | 11/2013 | Elliott | F16L 47/32 137/561 A |
| 2014/0096980 | A1 * | 4/2014 | Dzegan | E04C 2/525 169/16 |
| 2014/0251379 | A1 * | 9/2014 | Mackenzie | B08B 9/0321 134/18 |
| 2015/0297926 | A1 * | 10/2015 | Dzegan | A62C 35/58 169/56 |

* cited by examiner

FIRE PROTECTION SYSTEM MANIFOLD

CROSS-REFERENCE TO RELATED APPLICATION

This application claims the benefit of U.S. Provisional Patent Application No. 62/538,980, filed on Jul. 31, 2017 and entitled FIRE PROTECTION SYSTEM MANIFOLD, which is incorporated herein by reference in its entirety.

FIELD OF THE INVENTION

The present invention relates generally to water-based fire protection system plumbing, and more particularly, to a manifold that is adapted to supply multiple water-based fire protection systems.

BACKGROUND OF THE INVENTION

Large buildings such as office buildings, hotels, and warehouses commonly employ any of various fire protection sprinkler systems. There are many varieties of sprinkler systems including wet pipe, dry pipe, pre-action, and deluge. Each type of sprinkler system has advantages and disadvantages. A wet pipe sprinkler system provides quick response, but its pipes may freeze in cold weather. A dry pipe sprinkler system does not freeze, but it has a slower response time. A pre-action sprinkler system helps alleviate the response time deficiency of dry pipe systems by preemptively filling the pipes with water after a secondary detector is activated. However, pre-action sprinkler systems require more components and may be limited by the reliability of the second detector. In addition, wet pipe, dry pipe, and pre-action systems only release water in the area where the sprinkler heads are activated. A deluge system releases water out of all the sprinkler heads in the system as soon as a secondary detector is activated. This feature is beneficial to suppress fires quickly in areas containing combustible or highly flammable material. However, the release of more water can be wasteful and more damaging. If a building includes more than one of these sprinkler systems, the sprinkler systems would have to be connected by multiple tees and valves. It would be desirable if an apparatus could be provided to facilitate a connection to multiple sprinklers with fewer components to help reduce cost and labor and increase reliability.

Sprinkler systems require a large amount of piping inside of the building including risers to carry water vertically from one floor to another and cross mains which receive water from risers and supply water to a floor's sprinklers. In a building with multiple floors, multiple risers and cross mains are necessary. Additionally, there are sometimes obstructions in the building which make it difficult to reach a cross main with a riser of the proper size. It would be desirable if an apparatus could be provided to facilitate a way to split the water supply into multiple smaller risers that could reach a cross main that is obstructed.

Sprinkler systems also commonly include strainers in the risers or cross mains. Strainers are adapted to catch large particles and prevent them from clogging the system. However, these strainers take up space, and it would be desirable if a strainer could be incorporated into a manifold so that a separate strainer in a riser or cross main is not needed. This will decrease labor and cost when installing the system and will allow manifolds with integral strainers to be installed in spaces that would not accommodate a manifold and a separate strainer.

Outside of a building, a sprinkler system may require other components including drain piping and fire department connections. Drain piping is necessary to drain a dry pipe, pre-action, or deluge sprinkler system to restore it for future use. A fire department connection allows firefighters to supply or supplement water to the system. The supplemental water source is necessary for buildings where the utility water service has been removed or something has interrupted service to the building such as damage to the water supply infrastructure. Along with sprinkler systems, the building may have a standpipe system which requires another fire department connection.

It would be further desirable if a header, a strainer, a fire department connection, and a drain could be included in a single manifold to reduce the number of individual components necessary for the system, in order to reduce labor and cost and take up less space. It would be further desirable if such a manifold would also provide increased flow for the water flowing through it, with less friction.

ADVANTAGES OF A PREFERRED EMBODIMENT OF THE INVENTION

Among the advantages of a preferred embodiment of the invention is that it provides a manifold for supplying water to multiple fire protection systems from one water supply with increased flow and reduced friction. Other advantages of the invention are that it requires less labor to install and takes up less space than conventional alternatives. Furthermore, the preferred manifold comprises a drain, a strainer, and a fire department connection that can supply multiple systems so that separate components for these functions are no longer needed, further reducing cost and labor.

Still other advantages and features of this invention will become apparent from an examination of the following drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship. The term "fluid communication" is such an attachment, coupling or connection that allows for flow of fluid from one such structure or component to or by means of the other.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

Several terms are specifically defined herein. These terms are to be given their broadest reasonable construction consistent with such definitions, as follows:

The term "piping system" refers to interconnected piping comprising multiple pipes in fluid communication with each other. A piping system may also include valves, drains, a sprinkler system and a standpipe system.

The terms "header" and "manifold" refer to a pipe or duct through which fluid is distributed to or from multiple branches of a piping system.

The term "risers" refers to the vertical pipes that connect the water supply to the cross mains of a piping system.

The term "cross mains" refers to the pipes supplying the branch lines that supply the sprinklers of a sprinkler system.

The term "strainer" refers to a device capable of removing solids of a pre-determined size from the water in a piping system.

The term "water-based fire protection system" refers to either a sprinkler system or a standpipe system.

The terms "sprinkler" and "nozzle" refer to an apparatus that discharges water out of a piping system. A sprinkler may also include a primary fire detector such as a glass-bulb heat detector that may be activated to cause water to be discharged when one or more indications of fire are detected.

The term "sprinkler system" refers to a type of water-based fire protection system comprising a network of piping, connections and sprinklers in fluid communication with each other that are adapted discharge water from the sprinklers over a fire area to suppress the fire.

The term "wet pipe sprinkler system" refers to a sprinkler system comprising water-filled pipes that are adapted to discharge water immediately from one or more sprinklers upon activation by a primary fire detector.

The term "dry pipe sprinkler system" refers to a sprinkler system comprising pipes containing air, nitrogen or another gas under pressure that is released into the piping of the sprinkler system upon activation by a primary fire detector, wherein such release opens a valve known as a dry pipe valve to allow water to flow into the piping system and out the open sprinklers.

The term "pre-action sprinklers system" refers to a sprinkler system comprising automatic sprinklers, air-filled pipes, a valve, and a secondary fire detector that opens the valve when one or more indications of fire are detected.

The term "deluge sprinkler system" refers to a sprinkler system comprising open sprinklers or nozzles, a valve, and a secondary fire detector that will open the valve when one or more indications of fire are detected to allow water to flow into the piping system and discharge from all sprinklers or nozzles attached thereto.

The term "standpipe system" refers to a type of water-based fire protection system comprising piping, valves, hose connections, and allied equipment with the hose connections located in such a manner that water can be discharged in streams or spray patterns through attached hoses and nozzles, for the purpose of extinguishing a fire.

The term "fire department connection" refers to a connection that is adapted to allow a fire department to pump supplemental water into a water-based fire protection system or other piping system.

The term "post indicator valve" refers to a valve used for an underground piping system having a lockable actuator atop a post with a window indicating the open or shut status of the valve.

The term "control valve" refers to a valve that is adapted to control the flow of water to a water-based fire protection system.

The term "check valve" refers to a valve that allows flow in one direction only.

The term "underground pipe" refers to a pipe that satisfies the plumbing code for an underground water supply pipe.

The terms "concrete thrust block" and "concrete deadman" refer to concrete support for one or more components of a piping system.

SUMMARY OF THE INVENTION

The invention comprises a manifold for supplying two or more water streams from a single water supply. These streams may be used, for example, for water-based fire protection or sprinkler systems. A manifold according to the present invention includes an elongate body portion for holding water and having spaced apart first and second ends. The body portion includes a wall having a non-circular cross section and that includes a top portion and converging side portions that terminate at a bottom portion. An inlet extends downwards from the bottom of the body portion, is in fluid communication with the body portion, and allows water to flow into the body portion. A first outlet extending upwards from the top of the body portion proximate the first end and in fluid communication with the body portion is configured for allowing water to flow out of the body portion. Similarly, a second outlet extending upwards from the top of the body portion proximate the second end and in fluid communication with the body portion is configured for allowing water to flow out of the body portion. The second outlet includes a center that is spaced a distance L from a similar center of the first outlet.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
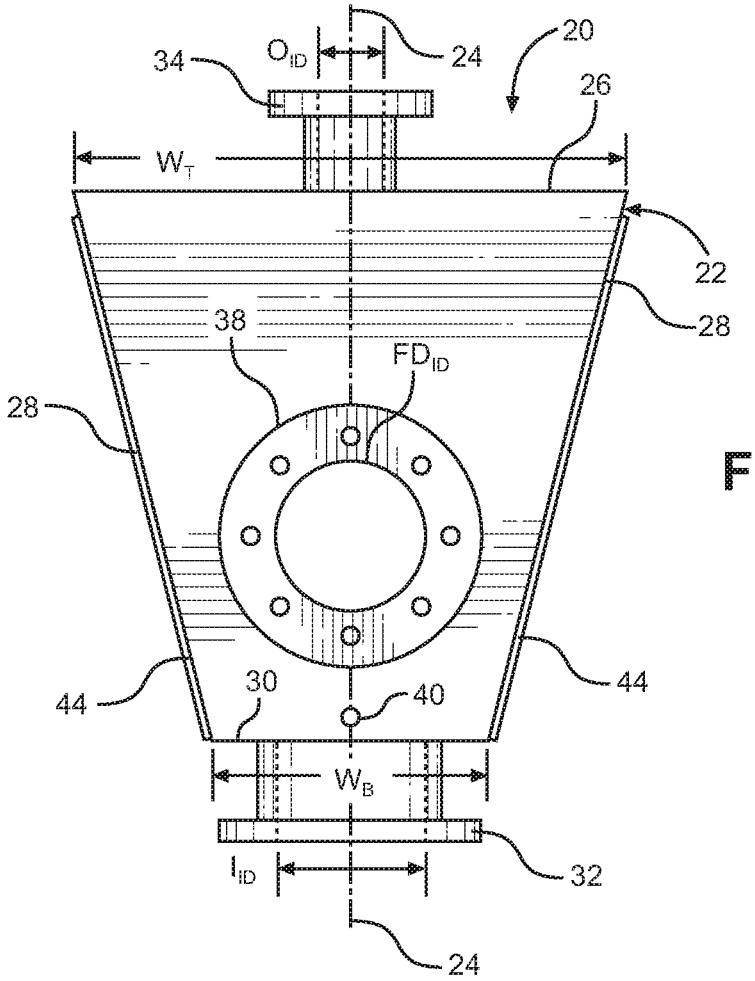
FIG. 1 is a front elevation view of a manifold according to an embodiment of the present invention.
Figure 2:
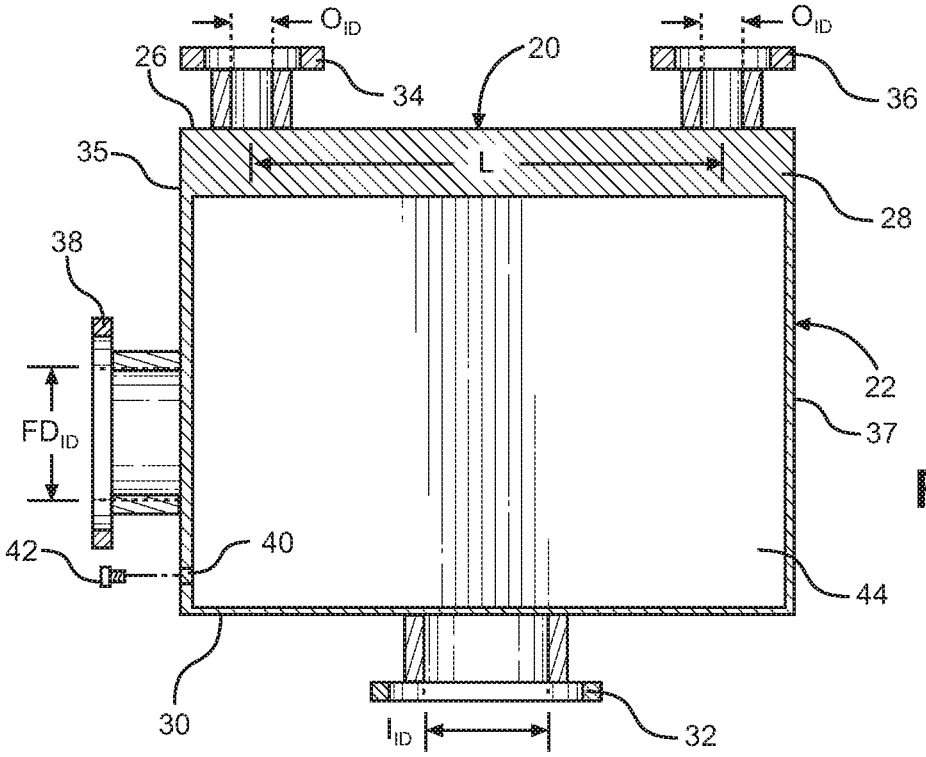
FIG. 2 is a side elevation view of the manifold of FIG. 1.

Referring now to the drawings, FIGS. 1 and 2 illustrate a fire protection system manifold 20 according to a preferred embodiment of the invention. The manifold 20 comprises a body portion 22 having a wide flattened top 26 joined to a pair of converging sides 28 that terminate at a narrow bottom 30. The top 26 of body portion 22 has a width $W_T$ and the bottom 30 of body portion 22 has a width $W_B$, which is narrower than width $W_T$, such that the body portion expands in width from bottom to top (and the sides converge from top to bottom). A single flanged inlet 32 having an opening with an inside diameter $I_{ID}$ extends from the narrower bottom end 30 of the body portion 22. Flanged first outlet 34, located adjacent first end 35, and flanged second outlet 36, located adjacent second end 37, extend from the wider top end 26 of the body portion 22, and each has an opening with an inside diameter $O_{ID}$. Preferably, width $W_T$ is at least twice as wide as inside diameter $O_{ID}$.

In preferred embodiments, outlets 34 and 36 are located at opposite ends of the top 26 of the body portion 22 of the manifold 20 and their centers are separated by length L. Length L is preferably at least thirty inches wide in order to help reduce water hammer and provide adequate spacing for adding pressure gauges and other attachments to the manifold 20. However, length L may be greater or lesser than thirty inches in other embodiments. Inlet 32 is preferably located along the bottom of the body portion 22 and is centered between outlets 34 and 36, such that the center of inlet 32 is spaced away from the centers of outlets 34 and 36 by a distance of L/2. The openings of inlet 32 and outlets 34 and 36 are oriented such that they are parallel with one another and with axis of symmetry 24. If the manifold 20 were bisected along a plane formed by axis 24 and projected along length L, the left and right halves (from the perspective of FIG. 1) would be mirror opposites of one another. Manifold 20 also includes a fire department connection (or supplemental water inlet 38) having an opening with inside diameter $FD_{ID}$ in first end 35. In this particular case, the inlet inside diameter $I_{ID}$ is preferably approximately eight inches, the first and second outlet inside diameters $O_{ID}$ are preferably approximately four inches, the fire department connection inside diameter $FD_{ID}$ is preferably approximately four inches, body width $W_T$ is preferably approximately eight inches, body width $W_B$ is preferably approximately six inches, and outlet separation length L is preferably approximately thirty inches. However, these dimensions are provided merely as a single example and may vary in other embodiments.

The manifold 20 differs from a standard "T" fitting in many ways. First, a typical "T" fitting has a circular cross section, whereas the manifold 20 has a non-circular cross section. The manifold body portion 22 expands from a narrow bottom end to a wide and flat top end, which provides a somewhat heart-shaped cross section. This shape reduces pressure loss as water flows in through the inlet 32 and then out via the outlets 34 and 36. In addition to having a non-circular cross-section, the manifold 20 design differs from a conventional "T" fitting in that the direction of water flow into the inlet 32 and out through the outlets 34 and 36 is in substantially the same direction. When in use, water flows upwards into the manifold 20 via inlet 32 and the manifold is eventually filled. Once the manifold 20 is filled, water then continues to flow upwards and it flows out of the manifold via the two upwardly-extending outlets 34 and 36. Water can flow out of both outlets 34, 36 at the same time or just a single outlet if the opposite outlet is blocked off by a shutoff device (e.g., a valve). By contrast, in a standard "T" fitting, the inlet is orthogonal (i.e., rotated by 90°) to the outlets. In those conventional devices, water flows into the fitting via a vertical inlet, changes direction by 90°, and then flows out of the fitting via left- and right-facing outlets. To have the water flow upwards in a system employing conventional "T" fittings, additional 90° elbows are typically fitted over the left and right outlets of the "T" fitting. One problem with this design is that, if the elbows are improperly joined to the "T" fitting, leaks can develop. Also, the abrupt change in direction of water flow results in pressure loss. In this case, however, having water enter and exit the manifold 20 in the same direction (with only minimal sideways deviation as the water is split between outlets 34 and 36) reduces pressure drop through the manifold and reduces the possibility of leaks and the number of components. Thus, the manifold 20 provides a better, simpler and easier method for splitting water flow (or joining together water flows if water is flowing through manifold in the opposite direction, i.e., in through outlets 34 and 36 and out inlet 32). It should be noted that by changing the direction of water flow, inlet 32 may serve as an outlet and outlets 34 and 36 may serve as inlets in order to join together two smaller streams of water into a single larger water stream.

As shown in FIG. 2, supplemental water inlet 38 is located in first end 35, but it could alternatively be located in second end 37. As discussed previously, openings of inlet 32 and outlets 34 and 36 are parallel with one another and with axis of symmetry 24. In this particular embodiment, connection 38 extends laterally from first end 35 of the body portion 22 and its opening is perpendicular to openings of inlet 32 and outlets 34 and 36 and also perpendicular with axis 24. Alternatively, the opening of connection 38 could be oriented parallel to the openings of inlet 32 and outlets 34 and 36 (not shown in the drawings), or in some other orientation.

The manifold 20 may also be provided with reinforcement plates 44 secured to each of the sides 28 and extending to or near the bottom 30 of the body portion 22. These plates 44 strengthen the body portion 22 in order to resist deformation or structural failure, including particularly when significant weight is placed onto the manifold, such as when vertical risers or equipment are installed onto the manifold. Plates 44 also help to stiffen the sides 28 and to reduce bulging that might result from pressure buildup within the manifold 20.

Additionally, the manifold 20 may include a drain opening 40 and corresponding drain plug 42 for draining water from inside the body portion 22. Preferably, the drain opening 40 is located near the narrow bottom 30 of the manifold body portion 22 to allow the manifold to be drained more fully.

With reference now to FIGS. 3-6, certain preferred embodiments of the fire protection system manifold 20 are provided with a strainer 45 that is located within the manifold for filtering particulate matter P from a fluid stream F entering the manifold 20 via the inlet 32 and before exiting the manifold via outlet 34 or 36. The strainer 45 may be formed integrally (i.e., as a non-removable component) with the manifold. For example, a mesh may be placed over the inlet 32 in order to prevent debris from entering the manifold 20. Additionally or alternatively, a mesh may be placed over the outlets 34 and 36 to prevent debris located within the manifold 20 from exiting the manifold. The mesh filters may be different size, such that a first filtering occurs at the inlet 32 to filter out larger debris and then a second filtering occurs at the outlets 34, 35 to filter out smaller debris.

In this case, the strainer 45 is removably inserted into the manifold 20 so that it may be cleaned, replaced, removed when not needed, etc. As such, strainer 45 is sized and shaped for removable insertion into the manifold 20 and to conform generally to the inner surface of body portion 22 when inserted. The strainer 45 is inserted into the manifold via an open first or second end of the body portion 22. The manifold 20 includes an end cover 31 that is adapted to be placed over and to form a water-tight seal with the open first or second end of the body portion 22. In this particular case, cover 31 may be removably and alternatively mounted to the first or second end of the body portion 22 by removable fasteners. In certain preferred embodiments, guides 46, such as stainless steel rods, bearings, etc., are mounted to the outer surface of strainer 45 to facilitate sliding it into and out of body portion 22.

Figure 3:
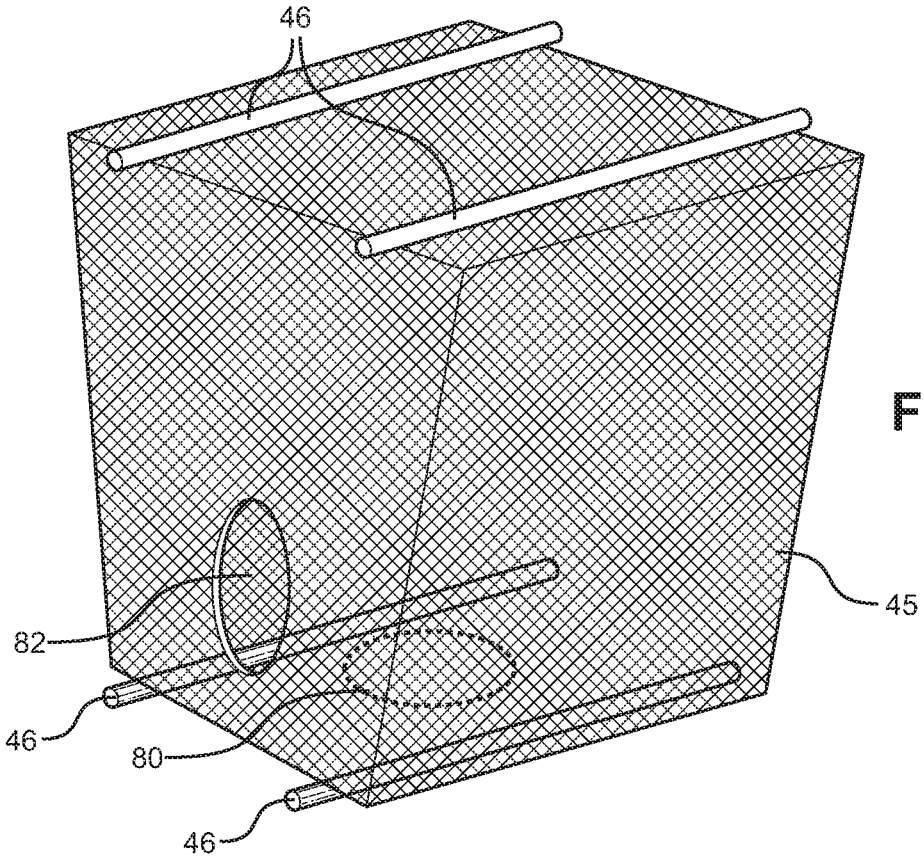
FIG. 3 is a perspective view illustrating a strainer according to an embodiment of the present invention.
Figure 4:
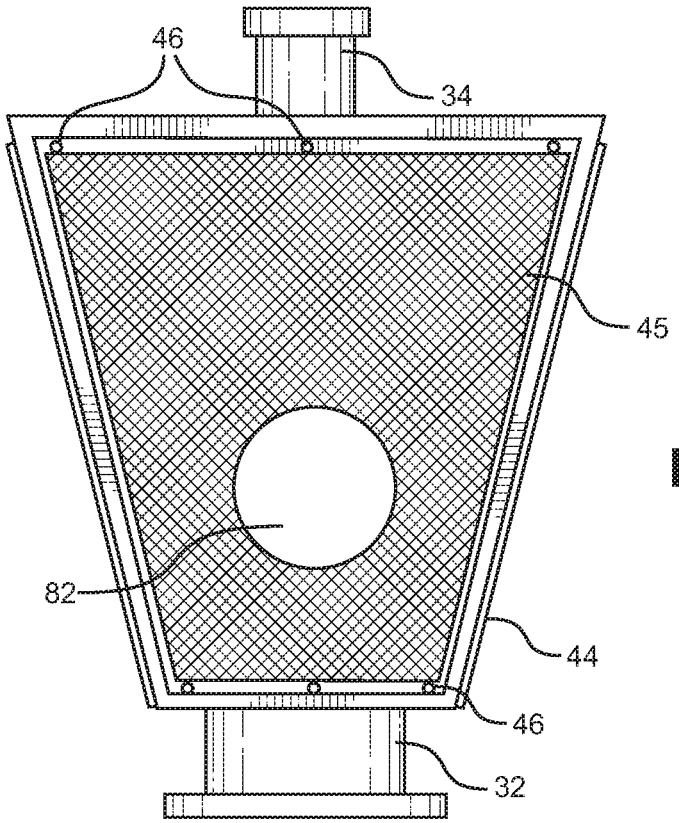
FIG. 4 is a front elevation view depicting the strainer of FIG. 3 being inserted into an open end of a manifold.
Figure 5:
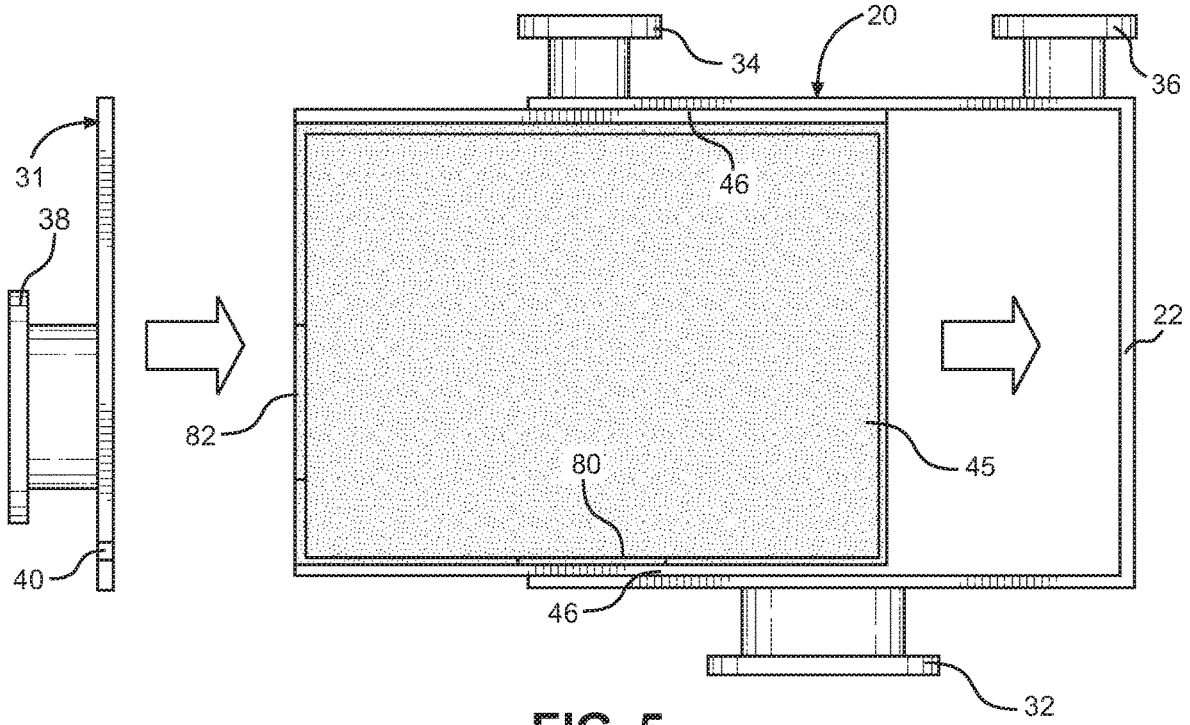
FIG. 5 is a side elevation view depicting the strainer of FIG. 3 being inserted into an open end of a manifold.
Figure 6:
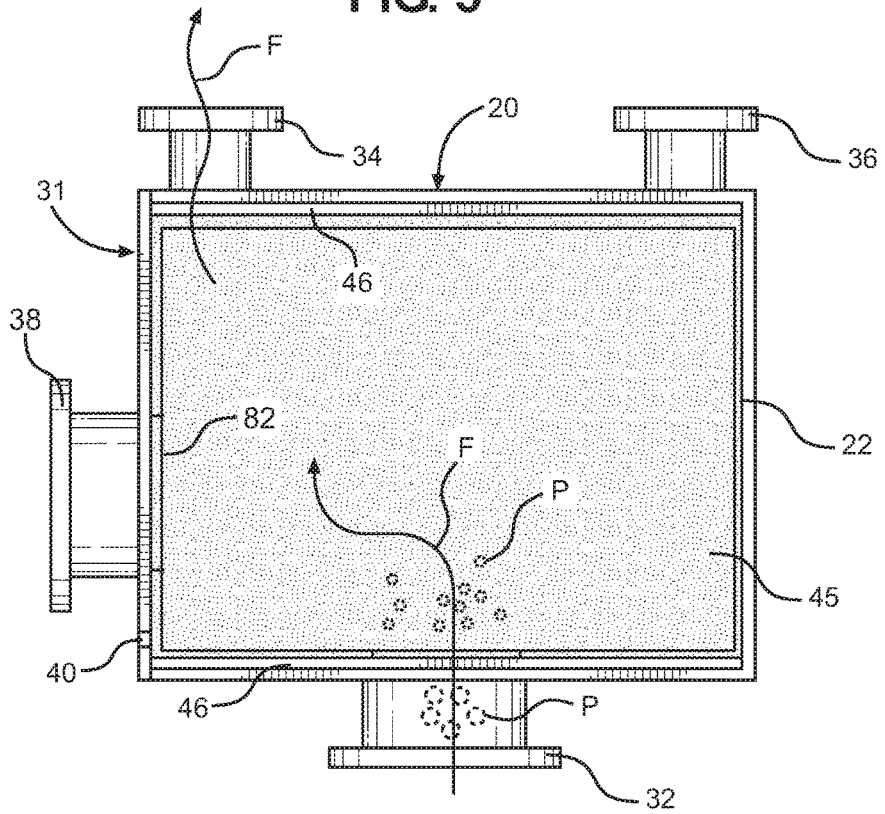
FIG. 6 is a side elevation view showing the manifold of FIG. 6 after the strainer has been fully inserted and a removable end cover has been placed onto the manifold.
Figure 7:
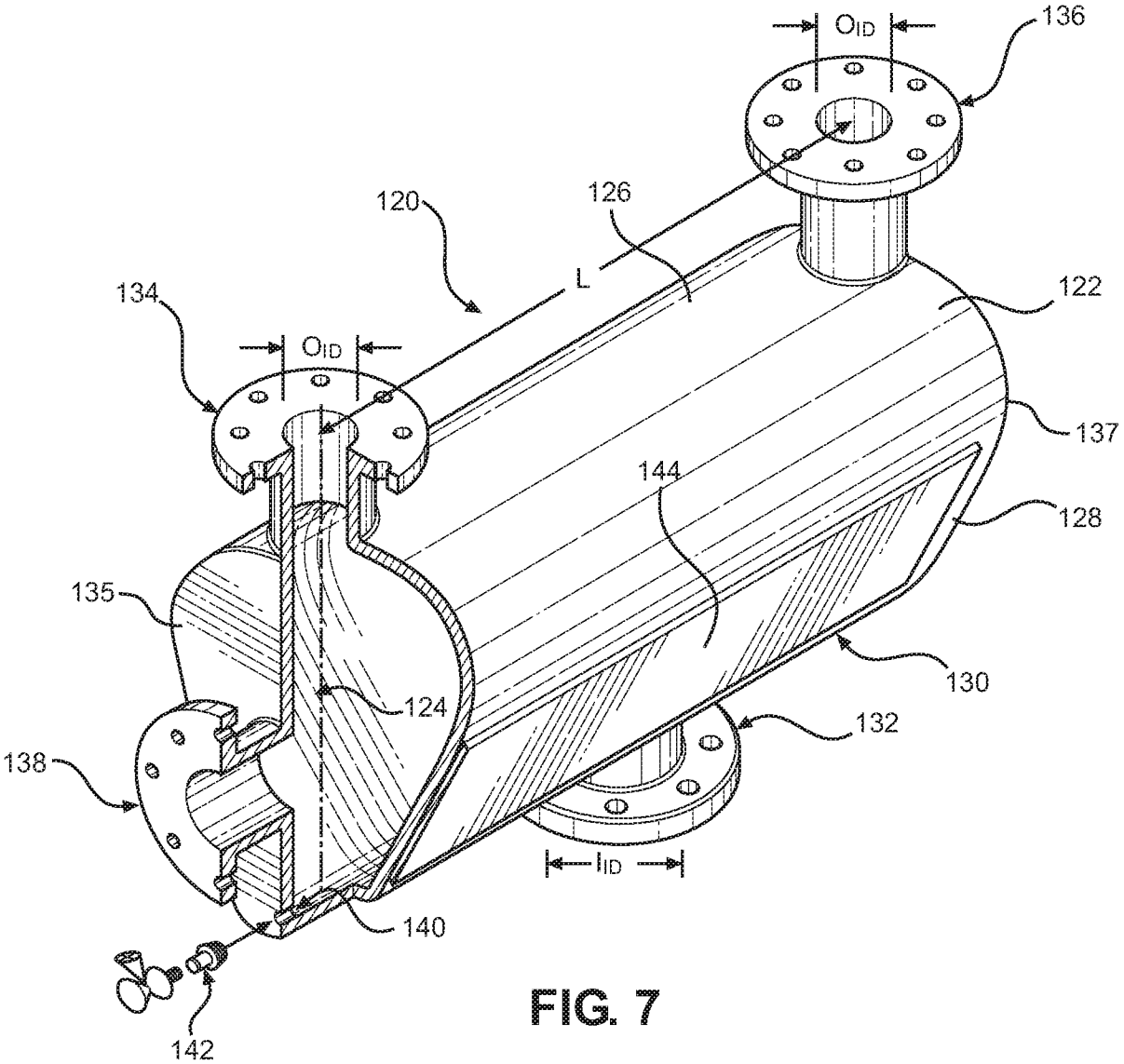
FIG. 7 is a perspective view of a manifold according to an alternative embodiment of the present invention.
Figure 8:
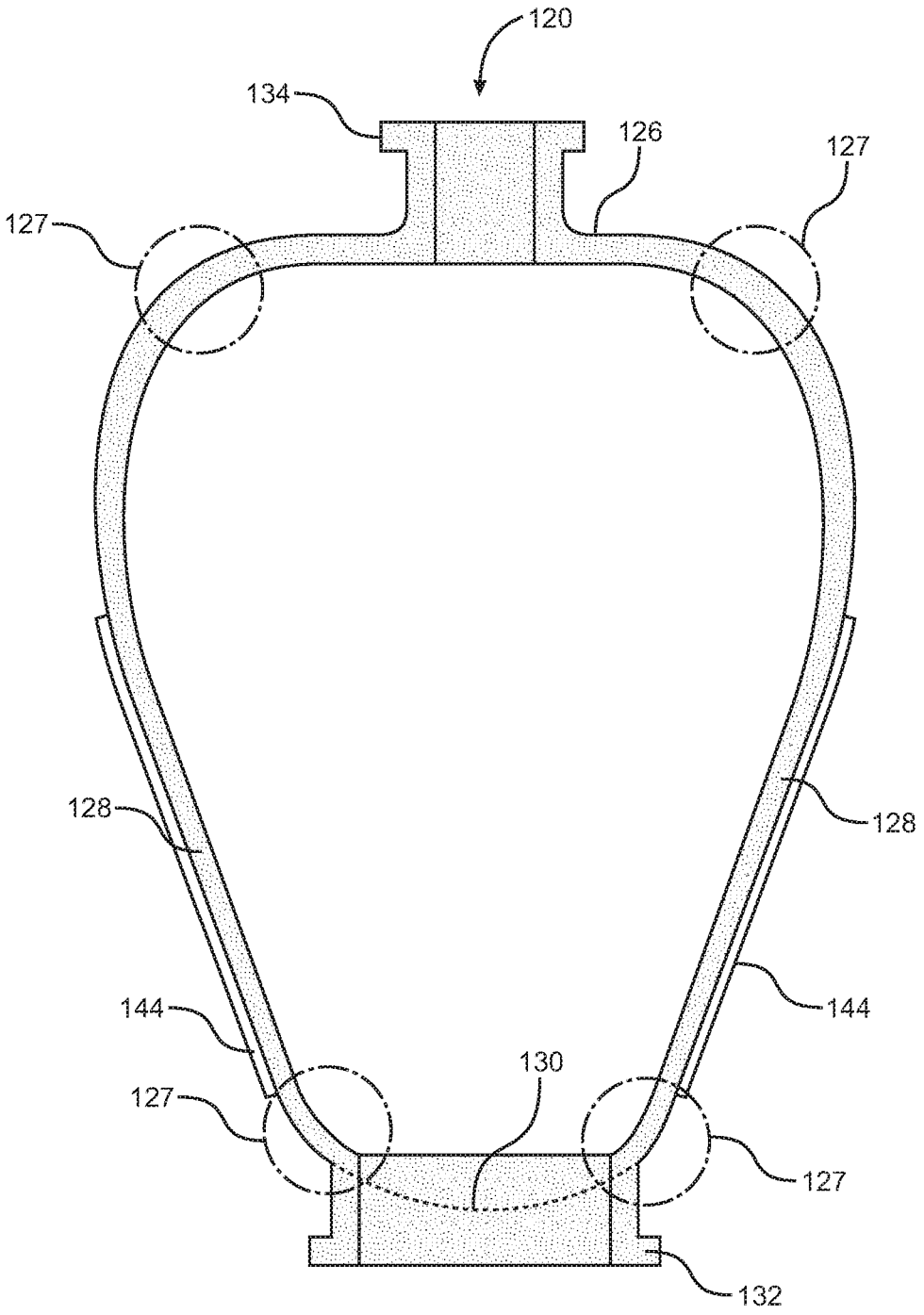
FIG. 8 is a front elevation view of the manifold shown in FIG. 7 after a removable end cover has been removed.
Figure 10:
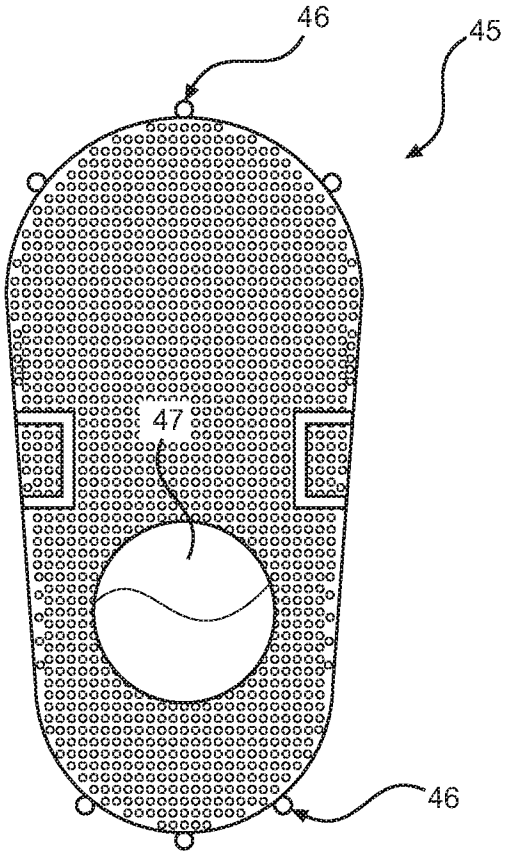
FIG. 10 is a front elevation view depicting a strainer suitable for the manifold shown in FIG. 8.
Figure 9:
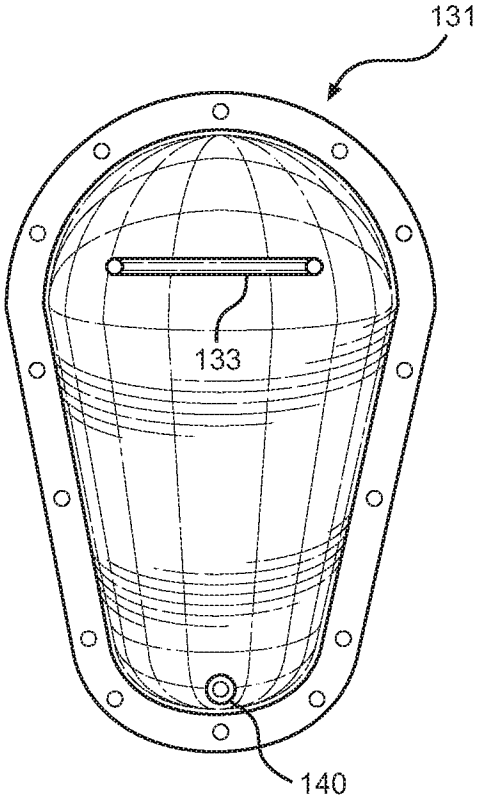
FIG. 9 is a front elevation view of a removable end cover according to an embodiment of the present invention.

As seen best in FIGS. 3 and 4, in this particular embodiment, the strainer 45 resembles a hollow cage formed from a shape-retaining plate, grate, or other similar material, including plates having openings, which enable water to flow through at least portions of the strainer but that traps debris of a selected size. The strainer 45 may be completely enclosed (e.g., a continuous mesh enclosure). However, in this embodiment, openings 80 and 82 are formed in the strainer and are located proximate inlet 32 and supplemental water inlet 38, respectively, when the strainer is fully inserted into the manifold 20. In certain cases, openings 80 and 82 are holes cut into the strainer 45 such that water flows freely into the manifold from inlets 32 and 38. However, in other cases, openings 80 and 82 are covered by a mesh that provides a first filtering such that "large" particulate matter is filtered out as water initially enters the manifold via these openings. In this case, the term "large" is relative and simply means particulate matter is that is larger than the "smaller" particulate matter filtered by portions of the strainer 45 other than openings 80 and 82.

As discussed above, once the manifold 20 is full, water begins to flow out of the manifold via either or both outlets 34, 36. In the version depicted, water may simply flow out through the porous wall that forms the strainer and no additional openings are provided in strainer 45 near the outlets 34, 36. However, in other cases, additional openings may be provided in the strainer 45 proximate the outlets 34, 36. This may occur, for example, if the strainer 45 is formed by a non-porous (e.g., plastic) outer wall that does not allow water to flow into or out of the strainer. Thus, in that case, additional openings would be required to allow water to flow out of the strainer. To function as a strainer in those cases, the openings would be covered by a mesh, screen, etc. to catch debris.

A fire protection system manifold 120 according to an alternative preferred embodiment of the invention is shown in FIGS. 7-10. Manifold 120 includes a body portion 122 having a wide flattened top 126 joined to a pair of converging sides 128 that terminate at bottom 130 that is narrower than the top. A single flanged inlet 132 having an opening with an inside diameter IID extends from the bottom end 130 of the body portion 122. A flanged first outlet 134 and a flanged second outlet 136 extend from the top end 126 of the body portion 122. Flanged outlets 134 and 136 each have openings with inside diameters OID. In certain embodiments, manifold 120 may also be provided with a removable end cover 131 that is adapted to be placed on first end 135 or second end 137 of the body portion 122 and that includes handle 133. Removable end covers 131 may be provided with a fire department connection 138 or drain opening 140 and drain plug 142, similar to those discussed above. When end cover 131 is removed from body portion 122, strainer 45 may be placed within the body portion.

It can be seen, therefore, that manifold 120 is structurally and functionally very similar to manifold 20. A primary difference between manifold 120 and manifold 20 is the shape of the interior of their respective body portions 122 and 22. As shown best in FIG. 8, in contrast to the abrupt transition between the top 26 and sides 28 of manifold 20, a smooth transition is provided between the top 126 and sides 128 of manifold 122. Similarly, in contrast to the abrupt transition between the bottom 30 and sides 28 of manifold 20, a smooth transition is provided between the bottom 130 and sides 128 of manifold 122. More particularly, each of the top and bottom portions 126, 130 are joined to the converging sides 128 by continuous rounded transition sections 127.

Figure 11:
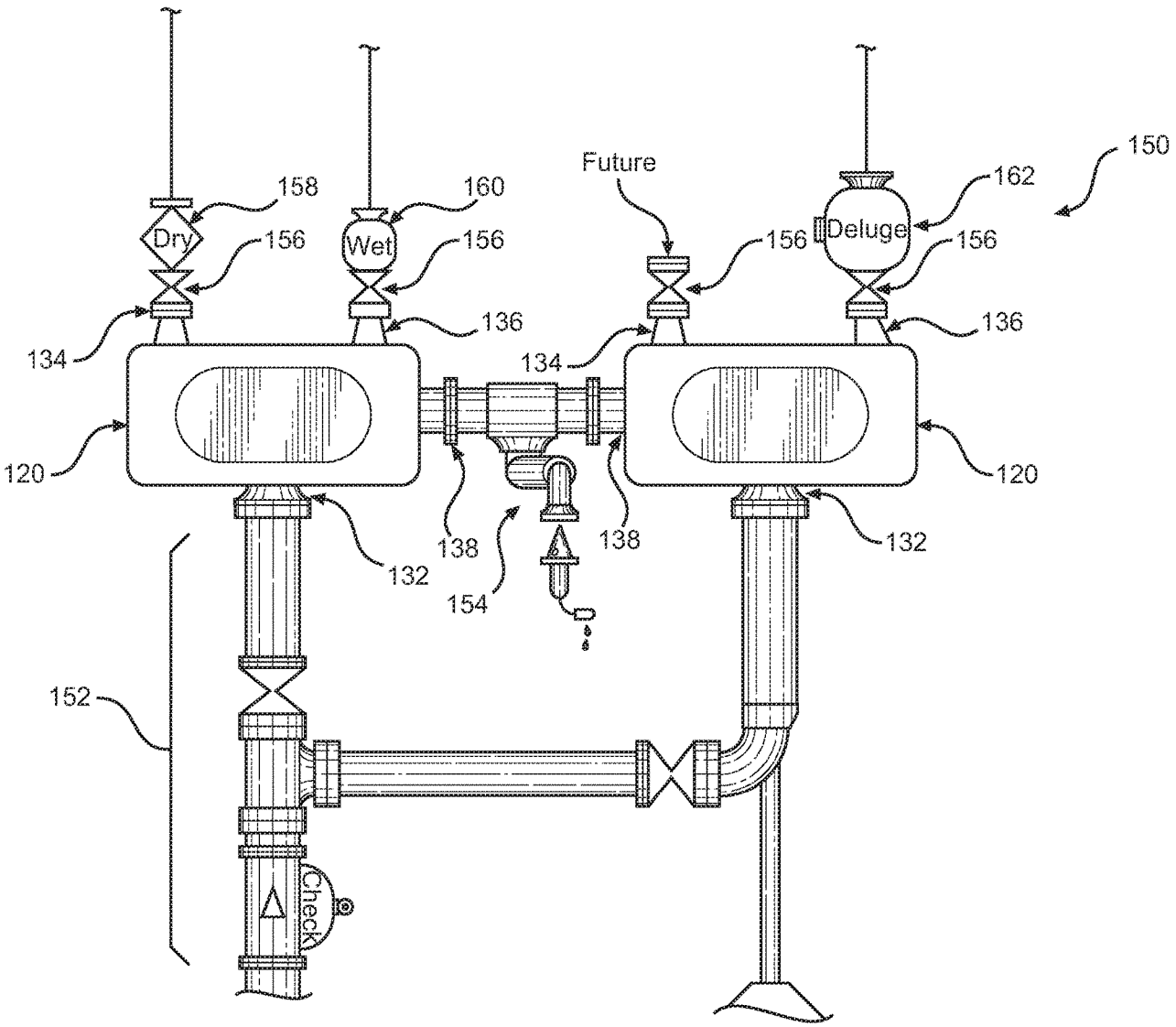
FIG. 11 is a depiction of a pair of manifolds in use to simultaneously supply multiple fire protection systems with water from a single water supply.

FIG. 11 illustrates use of a fire system assembly according the present invention, which system utilizes a pair of manifolds 120 in order to simultaneously supply four separate fire protection systems, including a dry pipe sprinkler system 158, a wet pipe sprinkler system 160, a deluge sprinkler system 162, and a blank for "future" use, with water provided via a single water supply 152. Both manifolds 120 are identical to those discussed previously and include inlets 132 connected to the water supply 152 and outlets 134 and 136 that are connected to systems 158, 160, and 162 or are blanked off for future use. Each of the outlets is attached to a separate control valve 156 so that each system may be selectively activated independently of the others by opening or closing the control valves. In addition, the manifolds 120 each include fire department connection 138, which are connected together to form a combined fire department connection 154. This allows firefighters, for example, to simultaneously supply water to both fire protection system manifolds 120 with one input.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. A manifold for providing two water streams from a single water supply, the manifold comprising:

an elongate body portion for holding water and having spaced apart first and second ends and including a wall having a non-circular cross section and including a top portion and converging side portions that join the top portion to a bottom portion;

an inlet in fluid communication with the body portion and configured for allowing water to flow into the body portion, the inlet extending from the bottom of the body portion;

a first outlet in fluid communication with the body portion and configured for allowing water to flow out of the body portion, the first outlet extending from the top of the body portion and located proximate the first end; and a second outlet in fluid communication with the body portion and configured for allowing water to flow out of the body portion, the second outlet extending from the top of the body portion and located proximate the second end and having a center that is spaced a distance L from a center of the first outlet, said inlet and said first and second outlets being oriented so that water flows into the inlet and out of the first and second outlets in substantially the same direction.

2. The manifold of claim 1 wherein the top portion has a width $W_T$ and the bottom portion has a width $W_B$, and wherein width $W_B$ is narrower than width $W_T$.

3. The manifold of claim 1 wherein the inlet has an opening with an internal diameter of $I_{ID}$ and the first and second outlets each have openings with internal diameters of $O_{ID}$, wherein internal diameter $I_{ID}$ is larger than internal diameter $O_{ID}$.

4. The manifold of claim 3 wherein internal diameter $I_{ID}$ is at least twice as wide as internal diameter $O_{ID}$.

5. The manifold of claim 1 further comprising an open end formed at either the first or second end of the body portion and a removable end cover configured to mount over and to enclose the open end of the body portion and to be removed from the body portion to provide access inside the body portion.

6. The manifold of claim 5 further comprising a removable strainer configured for insertion into the body portion via the open end and to filter debris out of a fluid stream carried into the manifold via the inlet before the fluid leaves the manifold via at least one of said first and second outlets.

7. The manifold of claim 6 wherein the manifold is provided with a first filter section and a second filter section and wherein debris carried by the fluid stream is first filtered by the first filter section and then smaller debris that was not filtered by the first filter section is subsequently filtered by the second filter section.

8. The manifold of claim 7 wherein the first filter section is located proximate the inlet and wherein a section filter section is located proximate each outlet.

9. The manifold of claim 6 wherein the strainer is in the form of an enclosure formed by a wall and having a hollow center, wherein the wall includes a plurality of openings that allows the fluid stream to pass into and out of the hollow center of the strainer.

10. The manifold of claim 9 wherein the wall includes an opening that is positioned adjacent the inlet when the strainer is correctly located within the manifold, wherein the opening allows the fluid stream to enter the strainer without being filtered.

11. The manifold of claim 6 further comprising guides for guiding and facilitating the insertion of the strainer into the body portion of the manifold.

12. The manifold of claim 1 further comprising a first filter section for filtering debris carried through the manifold by the water flowing through the body portion.

13. The manifold of claim 12 further comprising a second filter section placed sequentially after the first filter section such that debris carried by the water flowing through the body portion is first filtered by the first filter section and then smaller debris that was not filtered by the first filter section is subsequently filtered by the second filter section.

14. The manifold of claim 1 wherein the top portion is flat and is joined to a top end of the converging sides by continuous rounded transition sections and wherein a bottom end of the converging sides is joined to the bottom end by a continuous rounded transition.

15. The manifold of claim 1 further comprising a drain located proximate the bottom portion of the left end or right end of the body portion for enabling the manifold to be drained.

16. The manifold of claim 1 further comprising a supplemental inlet configured for allowing water to flow into the body portion.

17. The manifold of claim 16 wherein the supplemental inlet is located in the first end or second end of the body portion.

18. The manifold of claim 16 wherein the inlet, first outlet, and second outlet are parallel with one another in a vertical orientation and wherein the supplemental inlet is orthogonal to the inlet, first outlet, and second outlet in a horizontal orientation.

19. The manifold of claim 1 wherein the distance L is at least 30 inches.

20. The manifold of claim 19 wherein the inlet is located midway between the first and second outlets, such that a distance of L/2 separates a center of the inlet from the center of each of the outlets.

* * * * *